US007586058B2

(12) United States Patent
Kozar et al.

(10) Patent No.: US 7,586,058 B2
(45) Date of Patent: Sep. 8, 2009

(54) ELECTRICAL SWITCHING APPARATUS, AND ARC HOOD ASSEMBLY AND CHIMNEY THEREFOR

(75) Inventors: Aaron T. Kozar, Zelienople, PA (US); Frank K. Ostrowski, Natrona Heights, PA (US); Ronald W. Brand, Beaver Falls, PA (US)

(73) Assignee: Eaton Corporation, Cleveland, OH (US)

( * ) Notice: Subject to any disclaimer, the term of this patent is extended or adjusted under 35 U.S.C. 154(b) by 329 days.

(21) Appl. No.: 11/740,955

(22) Filed: Apr. 27, 2007

(65) Prior Publication Data

US 2008/0264906 A1 Oct. 30, 2008

(51) Int. Cl.
*H01H 33/02* (2006.01)

(52) U.S. Cl. ..... 218/157; 218/35; 335/201

(58) Field of Classification Search ..... 218/15, 218/34, 35, 36, 38–40, 46, 47, 148, 149, 218/150, 152–157; 200/306, 400; 335/16, 335/201, 202

See application file for complete search history.

(56) References Cited

U.S. PATENT DOCUMENTS 6,248,971 B1 * 6/2001 Morel et al. ..... 218/157
6,388,867 B1 5/2002 Rakus et al.
6,844,514 B2 * 1/2005 Bach et al. ..... 218/149
6,977,354 B1 12/2005 Shea et al.
7,368,679 B2 * 5/2008 Buxton et al. ..... 218/157
2008/0259534 A1 * 10/2008 Connor et al. ..... 361/622

* cited by examiner

*Primary Examiner*—Elvin G Enad
*Assistant Examiner*—Marina Fishman
(74) *Attorney, Agent, or Firm*—Martin J. Moran

(57) ABSTRACT

A chimney is provided for a circuit breaker arc hood assembly. The circuit breaker housing includes a number of arc chute vents structured to exhaust arc gases. The arc hood assembly includes a body having a first side facing the housing, and a second side opposite the first side. The first side includes a number of apertures. The chimney includes a base disposed at or about a corresponding one of the arc chute vents, a duct extending outwardly from the base and through a corresponding one of the apertures, and a plurality of resilient protrusions movably coupling the chimney to the first side of the body at or about the corresponding one of the apertures. The resilient protrusions bias the base toward engagement with the housing to resist the arc gases being undesirably discharged between the base and the housing.

23 Claims, 7 Drawing Sheets

ELECTRICAL SWITCHING APPARATUS, AND ARC HOOD ASSEMBLY AND CHIMNEY THEREFOR

BACKGROUND OF THE INVENTION

1. Field of the Invention

The invention relates generally to electrical switching apparatus and, more particularly, to arc hood assemblies for electrical switching apparatus, such as circuit breakers. The invention also relates to chimneys for circuit breaker arc hood assemblies.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include housing, and an operating mechanism which opens separable electrical contacts to interrupt the flow of current through the conductors of an electrical system in response to such fault conditions as detected, for example, by a trip unit.

Some low-voltage circuit breakers, for example, have arc chute vents on a portion (e.g., without limitation, the top) of the housing. When the separable electrical contacts rapidly open, for example, in response to an overload or short circuit condition, an arc is created which generates gases that are expelled from the vents. The gases can be extremely hot, are at least partly ionized, and may carry debris, such as molten metal particles. Furthermore, the gases and debris can be electrically conductive and, therefore, can cause additional undesirable arcing between the circuit breaker and grounded electrically conductive features proximate the circuit breaker, including but not limited to, the metallic enclosure in which such circuit breakers are typically installed. The gases may also be expelled with explosive force and may, therefore, damage components of the enclosure.

Accordingly, switchgear enclosures are typically designed to include one or more channels in which arc gases can be directed for dissipation thereof. Some switchgear cabinets also include an insulated barrier, commonly referred to as an arc hood, which is mounted above the arc chute vents of the circuit breaker through which the arc gases are exhausted. The arc hood functions to manage the effects of the arc gases and, in particular, to cool and dissipate the arc gases within the arc hood. However, there is room for improvement in arc hoods and, in particular, with respect to the interface (e.g., seal) between the arc hood, and the circuit breaker housing and the arc chute vents of the circuit breaker. Specifically, proper sealing is required in order to resist the escape of arc gases through gaps or openings between the circuit breaker and the arc hood, and to thereby avoid undesirable consequences associated therewith such as, for example, arcing across the poles of the circuit breaker and/or damage to components of the circuit breaker.

There is, therefore, room for improvement in arc hood assemblies for electrical switching apparatus, such as circuit breakers.

SUMMARY OF THE INVENTION

These needs and others are met by embodiments of the invention, which are directed to an arc hood assembly and chimney therefor for electrical switching apparatus, such as circuit breakers, wherein such chimney is biased toward the circuit breaker housing in order to establish and maintain an effective seal between the arc hood assembly and the circuit breaker.

As one aspect of the invention, a chimney is provided for an arc hood assembly of an electrical switching apparatus including a housing and a number of arc chute vents structured to exhaust arc gases from the housing. The arc hood assembly includes a body having a first side facing the housing, and a second side disposed opposite the first side. The first side includes a number of apertures. The chimney comprises: a base structured to be disposed at or about a corresponding one of the number of arc chute vents; a duct structured to extend outwardly from the base and through a corresponding one of the number of apertures; and a plurality of resilient protrusions structured to movably couple the chimney to the first side of the body at or about the corresponding one of the number of apertures. When the arc gases are exhausted from the corresponding one of the number of arc chute vents, the duct is structured to receive the arc gases and direct them into the body of the arc hood assembly. The resilient protrusions are structured to bias the base toward engagement with the housing at or about the corresponding one of the number of arc chute vents, in order to resist the arc gases being undesirably discharged between the base and the housing.

The base may comprise a planar portion and an upturned collar extending outwardly from the planar portion. The resilient protrusions may be a first tab and a second tab. The first side of the body of the arc hood assembly may further include a first slot disposed proximate the corresponding one of the number of apertures, and a second slot disposed proximate the corresponding one of the number of apertures opposite the first slot. Each of the first tab and the second tab may extend outwardly from the planar portion of the base and through a corresponding one of the first slot and the second slot, and may include a barb structured to secure the chimney to the first side of the body of the arc hood assembly, without a number of separate fasteners. Each of the first slot and the second slot may have an edge, and each of the first tab and the second tab may further include a taper extending from at or about the planar portion of the base toward the barb. When the base engages the housing, the taper may engage a corresponding one of the edge of the first slot and the edge of the second slot, to bias the base toward the housing in order to resist the base becoming disengaged from the housing.

The base may further comprise a plurality of posts and a plurality of resilient elements, wherein the posts are structured to extend outwardly from the planar portion and toward the first side of the body of the arc hood assembly, and each of the resilient elements may be structured to be disposed on a corresponding one of the posts between the planar portion of the base and the first side of the body of the arc hood assembly. The bias elements may be structured to bias the chimney toward the housing. The chimney may be a single-piece molded member wherein the base, the duct, and the resilient protrusions comprise different segments of the single-piece molded member.

As another aspect of the invention, an arc hood assembly is provided for an electrical switching apparatus including a housing and a number of arc chute vents structured to exhaust arc gases from the housing. The arc hood assembly comprises: a body including a first side structured to face the housing and including a number of apertures, and a second side disposed opposite the first side; and a number of chimneys, each of the chimneys comprising: a base structured to be disposed at or about a corresponding one of the number of arc chute vents, a duct extending outwardly from the base and through a corresponding one of the number of apertures, and a plurality of resilient protrusions movably coupling such each of the chimneys to the first side of the body at or about the corresponding one of the number of apertures. When the arc gases are exhausted from the corresponding one of the number of arc chute vents, the duct is structured to receive the arc gases and direct them into the body of the arc hood assembly. The resilient protrusions are structured to bias the base toward engagement with the housing at or about the corresponding one of the number of arc chute vents, in order to resist the arc gases being undesirably discharged between the base and the housing.

As another aspect of the invention, an electrical switching apparatus comprises: a housing; separable contacts enclosed by the housing; an operating mechanism structured to open and close the separable contacts, which are structured to create an arc that generates arc gases when the separable contacts open; a number of arc chute vents disposed on the housing and being structured to exhaust the arc gases from the housing; and an arc hood assembly comprising: a body including a first side facing the housing, and a second side disposed opposite the first side, and a number of chimneys, the first side including a number of apertures, each of the chimneys comprising: a base structured to be disposed at or about a corresponding one of the number of arc chute vents, a duct extending outwardly from the base and through a corresponding one of the number of apertures, and a plurality of resilient protrusions movably coupling such each of the chimneys to the first side of the body at or about the corresponding one of the number of apertures. The arc gases are exhausted from the corresponding one of the arc chute vents, through the duct, and into the body of the arc hood assembly. The resilient protrusions bias the base toward engagement with the housing at or about the corresponding one of the number of arc chute vents, in order to resist the arc gases being undesirably discharged between the base and the housing.

The electrical switching apparatus may be a circuit breaker, wherein the housing of the circuit breaker further includes a cassette having a bottom, and first and second sides extending perpendicularly outwardly from the bottom. Each of the first and second sides of the cassette may include an end, and the circuit breaker may be disposed between the first and second sides of the cassette. The body of the arc hood assembly may be coupled to the first and second sides of the cassette at or about the end thereof.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
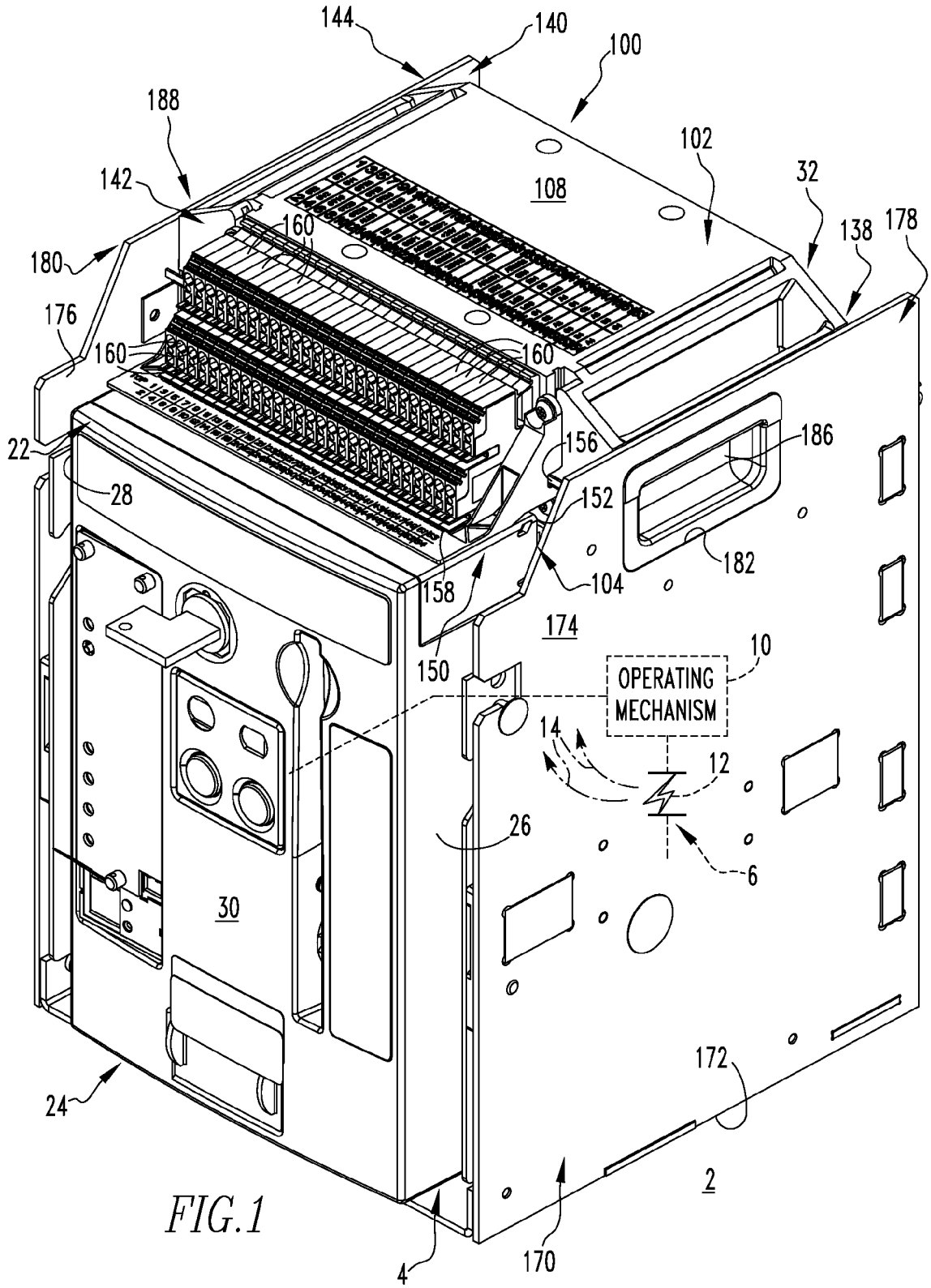
FIG. 1 is an isometric view of a circuit breaker and an arc hood assembly therefor, in accordance with an embodiment of the invention, showing the circuit breaker operating mechanism, a pair of separable contacts, and an arc in block form.

For purposes of illustration, embodiments of the invention will be described as applied to low-voltage circuit breakers, although it will become apparent that they could also be applied to a wide variety of electrical switching apparatus (e.g., without limitation, circuit switching devices and other circuit interrupters, such as contactors, motor starters, motor controllers and other load controllers) other than low-voltage circuit breakers and other than low-voltage electrical switching apparatus.

Directional phrases used herein, such as, for example, left, right, top, bottom, upper, lower, front, back and derivatives thereof, relate to the orientation of the elements shown in the drawings and are not limiting upon the claims unless expressly recited therein.

As employed herein, the term "DIN rail" refers to any known or suitable connecting structure for mounting and/or electrically connecting a number of components (e.g., without limitation, electrical terminals) to an electrical switching apparatus, wherein the structure is designed to satisfy standards established by Deutsches Insitut für Normung eV (DIN), which is a standard-setting organization for Germany.

As employed herein, the term "fastener" shall mean a separate element or elements which is/are employed to connect or tighten two or more components together, and expressly includes, without limitation, rivets, pins, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
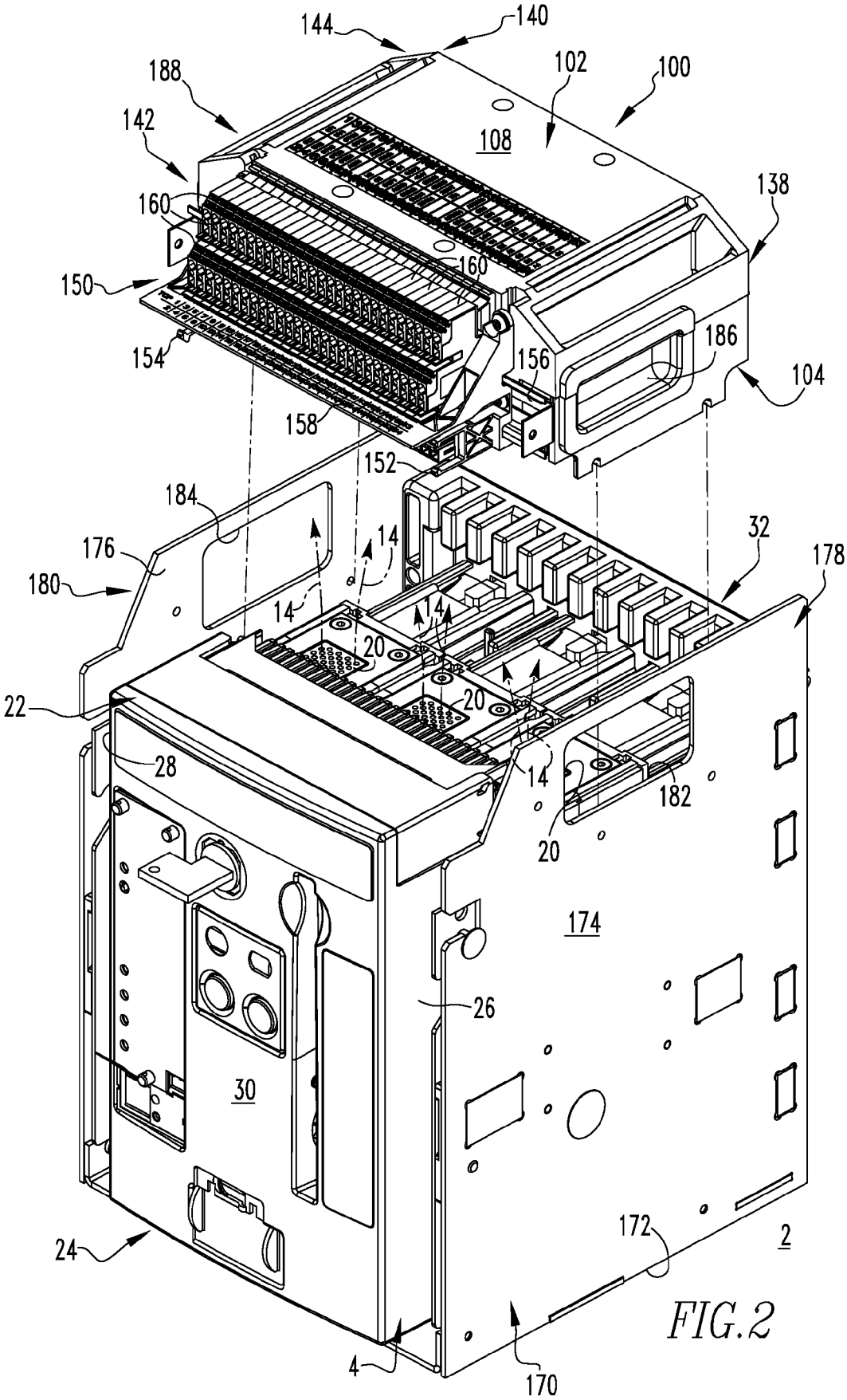
FIG. 2 is a partially exploded isometric view of the circuit breaker and arc hood assembly therefor of FIG. 1.

FIGS. 1 and 2 show an electrical switching apparatus such as, for example, a low-voltage circuit breaker 2, and an arc hood assembly 100 therefor. The circuit breaker 2 includes a housing 4, separable contacts 6 (shown in simplified form in hidden line drawing in FIG. 1) enclosed by the housing 4, an operating mechanism 10 (shown in simplified form in hidden line drawing in FIG. 1), which is structured to open and close the separable contacts 6 (FIG. 1), and a number of arc chute vents 20 (FIG. 2; also partially shown in simplified form in phantom line drawing in FIGS. 5 and 7) disposed on the housing 4 and being structured to exhaust arc gases 14 (FIGS. 2 and 5) from the housing 4. The arc gases 14 are generated from an arc 12 that is created when the separable contacts 6 open, as shown in simplified form in FIG. 1.

The housing 4 of the example circuit breaker 2 includes a first end 22, a second end 24, a first side 26, a second side 28, a front 30, and a back 32, and includes three arc chute vents 20 disposed at or about the first end 22, as shown in FIG. 2. The example circuit breaker 2 is disposable within a cassette 170, which in the example shown and described herein includes a bottom 172 and first and second sides 174,176 extending perpendicularly outwardly from the bottom 172. When the circuit breaker 2 is disposed within the cassette 170, as shown in FIGS. 1 and 2, the first side 26 of the circuit breaker 4 is disposed adjacent the first side 174 of the cassette 170, and the second side 28 of the circuit breaker housing 4 is disposed adjacent the second side 176 of the cassette 170. Thus, the second end 24 of the circuit breaker housing 4 is disposed adjacent the bottom 172 of the cassette 170, and the first end 22 of the circuit breaker housing 4 is disposed at or about the ends 178,180 of the first and second sides 174,176 of the cassette 170, as shown. As will be discussed, the ends 178,180 of the example cassette sides 174,176, respectively include access holes 182,184 (both shown in FIG. 2) to receive corresponding recesses 186,188 of the arc hood assembly 100, when the arc hood assembly 100 is installed at or about the first end 22 of the circuit breaker housing 4, as shown in FIG. 1.

Figure 3:
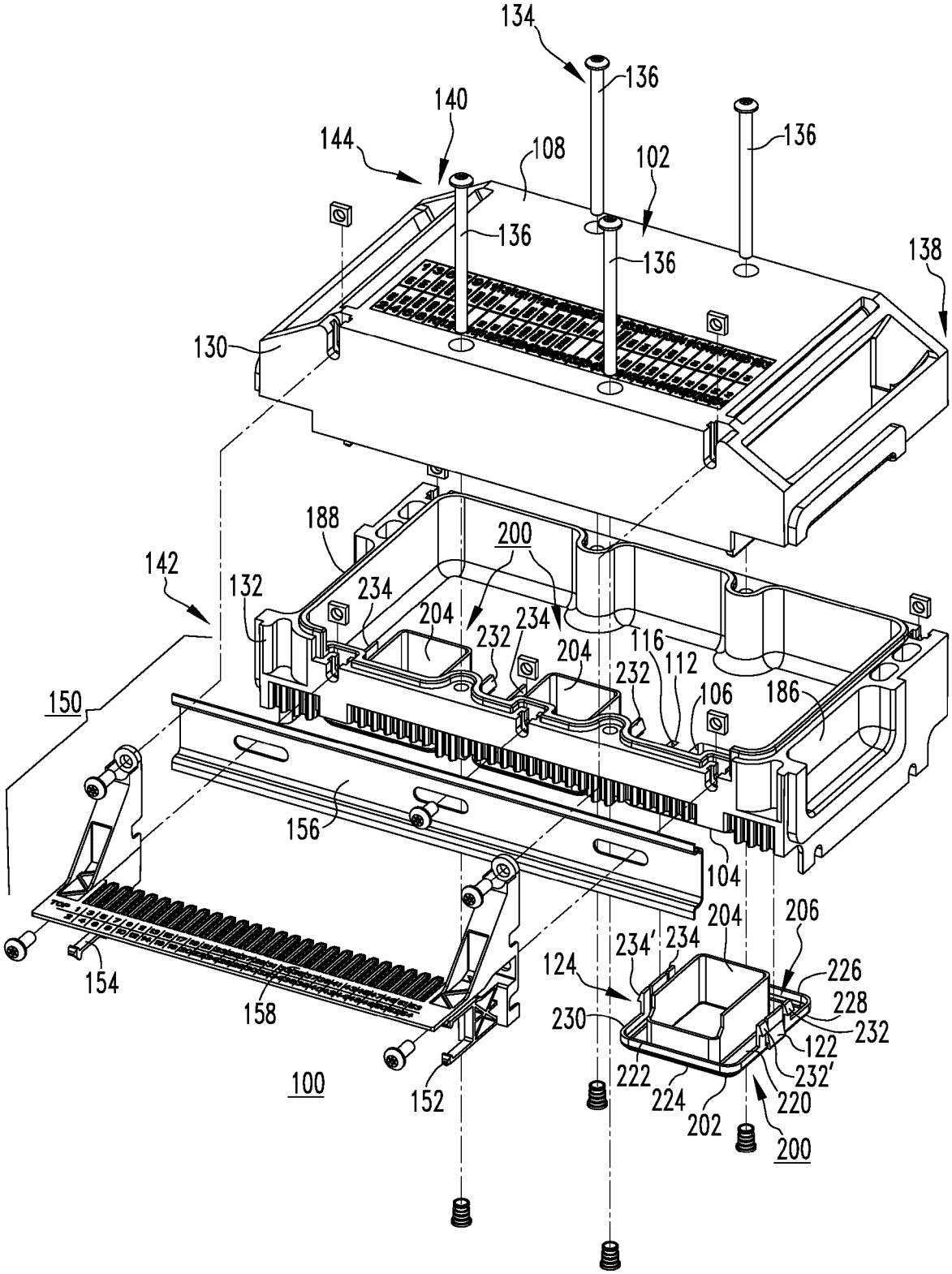
FIG. 3 is a partially exploded isometric view of the arc hood assembly of FIG. 2, also showing chimneys therefor, in accordance with an embodiment of the invention.
Figure 4:
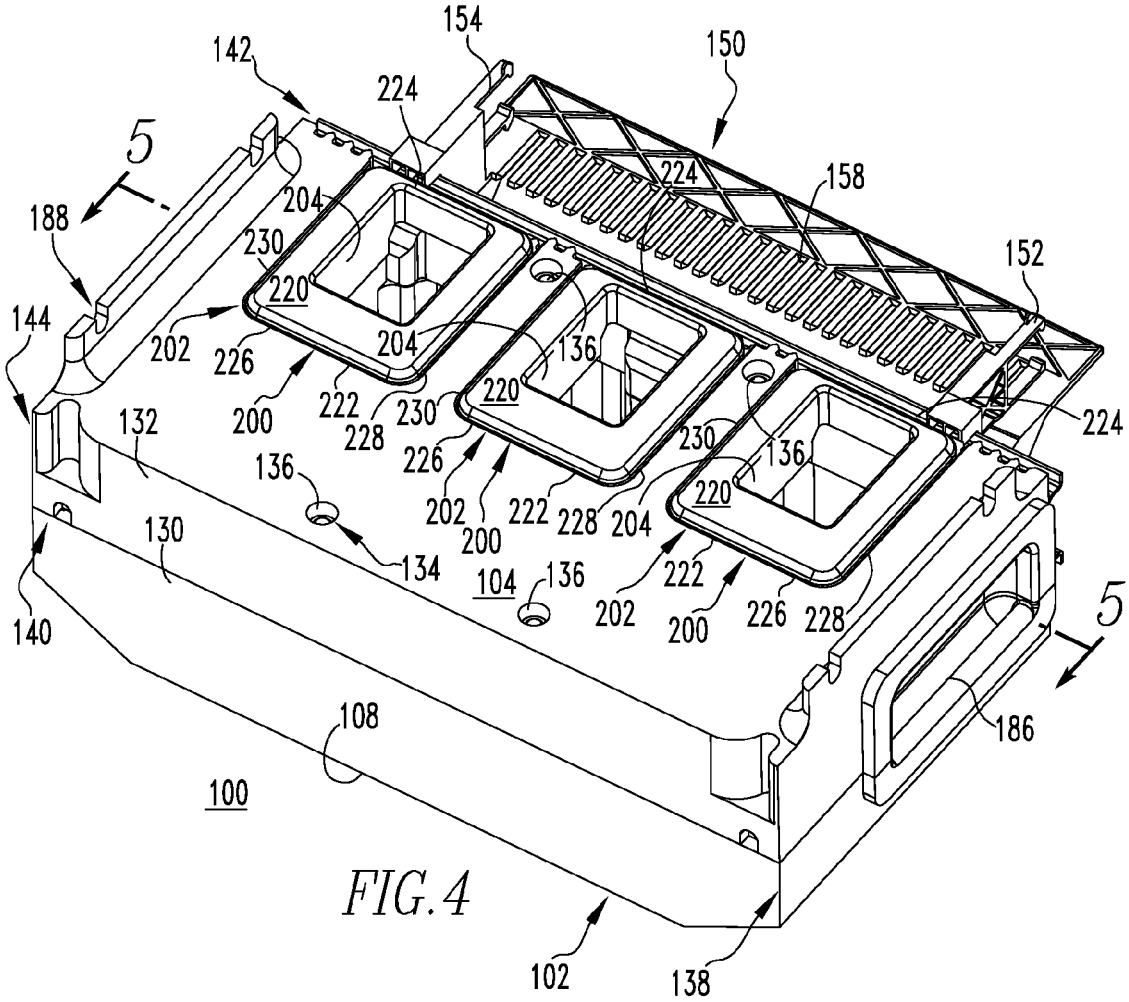
FIG. 4 is an isometric view of the underside of the arc hood assembly of FIG. 2, showing three chimneys therefor.
Figures 5, 7:
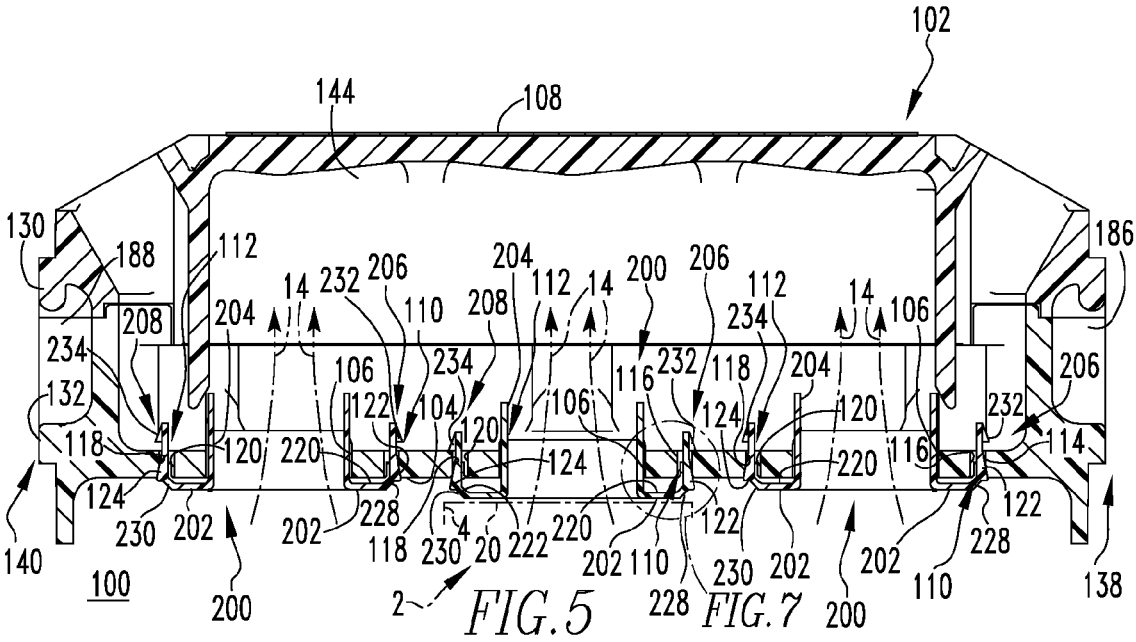
FIG. 5 is a sectional view taken along line 5-5 of FIG. 4, also showing a portion of one arc chute vent of the circuit breaker housing in simplified form in phantom line drawing.
FIG. 7 is a close-up view of a portion of one of the chimneys, a portion of the arc hood assembly, and a portion of the arc chute vent of FIG. 5.

When the circuit breaker 2 is fully installed within the cassette 170 beneath (with respect to FIGS. 1 and 2) the arc hood assembly 100, the arc hood assembly 100 is structured to engage and align with the first end 22 of the circuit breaker housing 4 and, in particular, the arc chute vents 20 (FIG. 2) thereof. More specifically, as shown in FIGS. 3-5, the example arc hood assembly 100 includes a body 102 having a first side 104 structured to face the circuit breaker housing 4 (best shown in FIG. 2) and including a number of apertures 106 (FIGS. 3, 5 and 7), and a second side 108 disposed opposite the first side 104. A chimney 200 is disposed in each of the apertures 106, as best shown in the cross-sectional view of FIG. 5. The example arc hood assembly 100 includes three apertures 106 and three chimneys 200 therefor. One of the chimneys 200 will now be described in greater detail. It will, however, be appreciated that the other two chimneys 200 are substantially identical in the example shown and described herein. Also, it will be appreciated that any known or suitable number and/or configuration of chimneys (e.g., without limitation, chimney 200 of FIGS. 3-7; see also chimneys 300 and 400 of FIGS. 8-9 and 10, respectively) could be employed, without departing from the scope of the invention.

Figure 6:
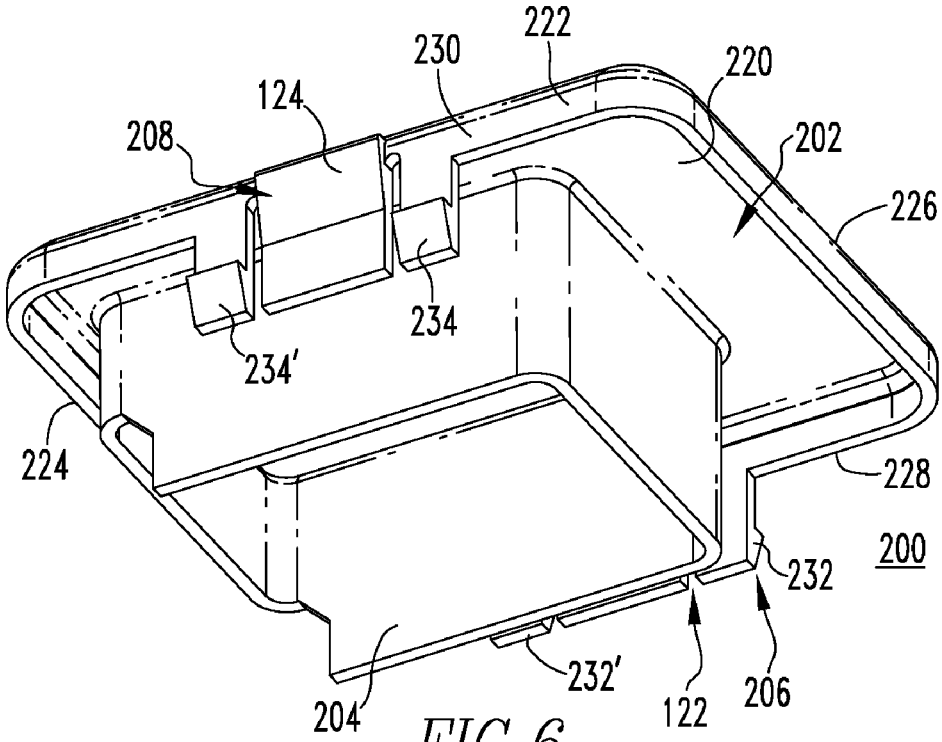
FIG. 6 is an isometric view of one of the chimneys of FIG. 5.
Figure 7:
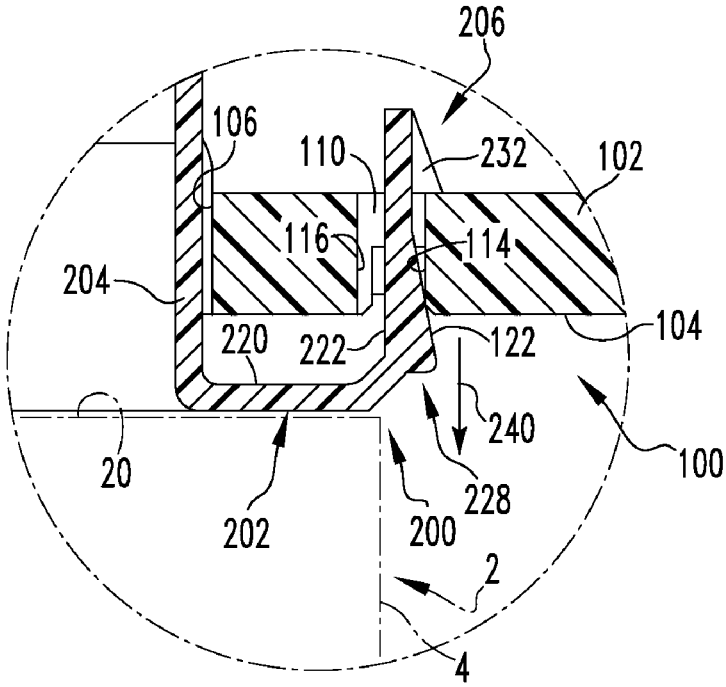

As shown in FIGS. 5-7, each of the example chimneys 200 includes a base 202, which is structured to be disposed at or about a corresponding one of the aforementioned arc chute vents 20 of the circuit breaker 2, as partially shown in simplified form in phantom line drawing in FIG. 5. A duct 204 extends outwardly from the base 202 and through a corresponding one of the apertures 106. A plurality of resilient protrusions, which in the example shown and described herein are first and second tabs 206,208 (both shown in FIG. 6), movably couple each of the chimneys 200 to the first side 104 of the body 102 of the arc hood assembly 100 at or about the corresponding aperture 106 thereof, as shown in FIG. 5. Thus, when the arc gasses 14 (indicated by arrows 14 in FIGS. 1, 2 and 5) are exhausted from the corresponding arc chute vent 20 (FIG. 2), the duct 204 of the chimney 200 receives the arc gasses 14 and directs them into the body 102 of the arc hood assembly 100 to be cooled and dissipated therein. As will be discussed in greater detail hereinbelow, the first and second tabs 206,208 are structured to bias the base 202 toward engagement with the circuit breaker housing 4 (partially shown in simplified form in phantom line drawing in FIG. 5) at or about the corresponding arc chute vent 20 (one arc chute vent 20 is shown in simplified form in phantom line drawing in FIG. 5), in order to resist the arc gasses 14 being undesirably discharged between the base 202 and the housing 4. Accordingly, it will be appreciated that the arc chute vent 20 is only shown in exaggerated form, slightly spaced apart from the base 202 of the chimney 200 in FIG. 5, for simplicity of illustration.

As best shown in FIG. 6, the base 202 of the example chimney 200 includes a planar portion 220 and an upturned collar 222, which extends outwardly from the planar portion 220 toward the first side 104 of the body 102 of the arc hood assembly 100, as shown in FIGS. 3-5 and 7. The chimney duct 204 extends outwardly from the planar portion 220. The first and second tabs 206,208 of the example chimney 200 also extend outwardly from the planar portion 220 at or about the upturned collar 222 and generally parallel with respect to the duct 204. The base 202 has a first end 224, a second end 226 disposed opposite and distal from the first end 224, a first edge 228, and a second edge 230 disposed opposite and distal from the first edge 228. Accordingly, it will be appreciated that the base 202 of the example chimney 200 is generally rectangular in shape, with the first tab 206 being disposed at or about the first edge 228 of the base 202, and the second tab 208 being disposed at or about the second edge 230 of the base 202 opposite the first tab 206, as shown.

Referring again to FIG. 5, and also to the close-up view of FIG. 7, it will be appreciated that the first side 104 of the body 102 of the arc hood assembly 100 further includes a first slot 110 disposed proximate the corresponding aperture 106, and a second slot 112 (FIG. 5) disposed proximate such aperture 106 opposite the first slot 110. The first and second tabs 206,208 extend outwardly from the planar portion 220 of the base 202 and through the first and second slots 110,112, respectively, as shown in FIG. 5. The first and second tabs 206,208 also include at least one barb 232,234 (first and second barbs 232,234 are shown for each chimney 200 in the sectional view of FIG. 5; see also barbs 232,232' and 234,234' of FIG. 6) for securing the chimney 200 to the first side 104 of the body 102 of the arc hood assembly 100, without requiring a number of separate fasteners.

As shown in FIG. 6, the first and second tabs 206,208 of the example chimney 200 are each segmented to include two barbs 232,232' and 234,234', respectively. However, it will be appreciated that any known or suitable number and configuration of tabs (e.g., without limitation, 206,208) and barbs (e.g., without limitation, 232,232',234,234') could be employed without departing from the scope of the invention, as will be described, for example, with respect to FIGS. 8-10, discussed hereinbelow.

Referring back to FIG. 5, and also to FIG. 7, the first slot 110 includes first and second edges 114,116. Likewise, the second slot 112 (FIG. 5) includes first and second edges 118,120 (FIG. 5). The first and second tabs 206,208 (both shown in FIG. 5) each include a taper 122,124, respectively, extending from at or about the planar portion 220 of the base 202 toward the barb 232,234. As best shown in FIG. 7, when the tab 206 is inserted through the corresponding first slot 110 in the body 102 of the arc hood assembly 100, and the base 202 engages the circuit breaker housing 4 (partially shown in simplified form in phantom line drawing), and the taper 122 engages the corresponding one of the first and second edges 114,116 (taper 122 is engaging first edge 114 of the first slot 110 in FIG. 7) of the slot 110, the taper 122 biases the base toward the housing 4 in the direction generally indicated by arrow 240. In this manner, the disclosed chimney 200 is resilient (e.g., spring-loaded), in order to establish and maintain an effective seal between the base 202 of the chimney 200 and the circuit breaker housing 4 and thereby resist the base 202 from becoming disengaged from the housing 4, and undesirably allowing arc gasses 14 (FIGS. 2 and 5) to escape therebetween.

Figure 8:
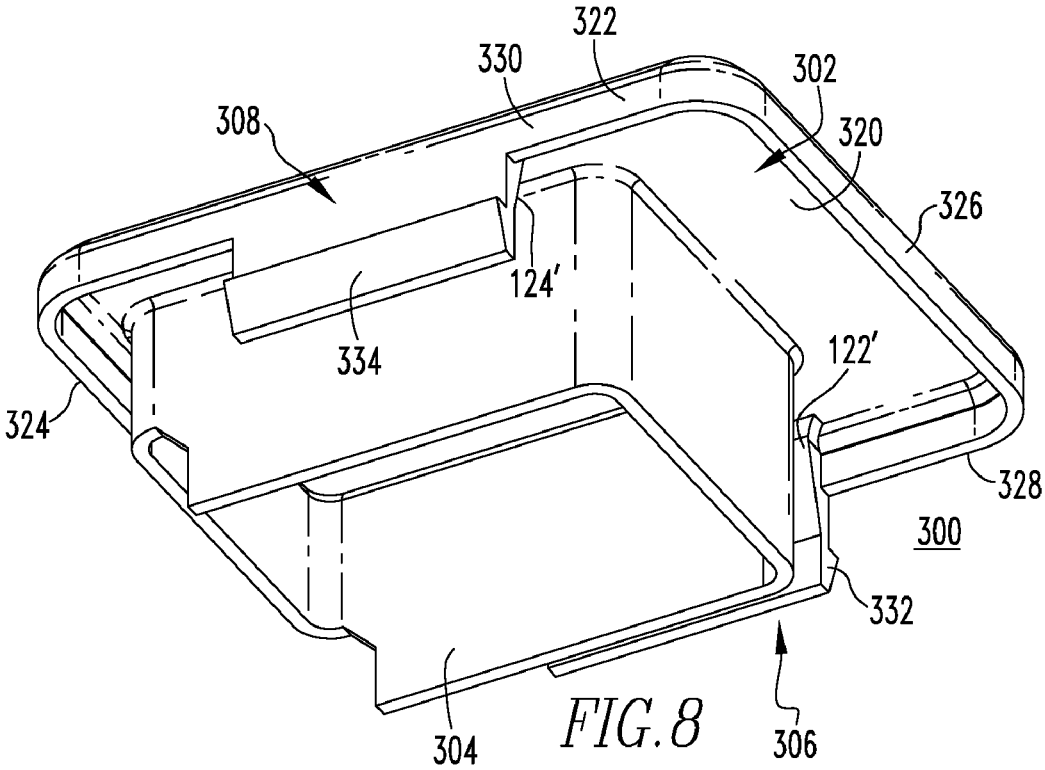
FIG. 8 is an isometric, partially exploded view of a chimney in accordance with another embodiment of the invention.

It will be appreciated that the example chimney 200 is a single-piece molded member wherein the base 202, duct 204, and resilient protrusions (e.g., tabs 206,208) comprise different segments of the same piece of material that comprises the single-piece molded member 200. However, as previously discussed, it will be appreciated that the chimney (e.g., without limitation, 200) could have any known or suitable alternative configuration in order to provide the desired seal between the chimney (e.g., without limitation, 200) and the circuit breaker housing 4, as contemplated by the invention. For example and without limitation, FIG. 8 shows an example chimney 300 in accordance with another embodiment of the invention wherein the chimney 300 includes a base 302 having a planar portion 320, which is generally rectangular in shape, and includes first and second opposing ends 324,326 and first and second opposing sides 328,330. Similar to chimney 200, previously discussed hereinabove in connection with FIGS. 3-7, the chimney 300 further includes a duct 304, first and second tabs 306,308, and an upturned collar 322, all of which extend outwardly from the planar portion 320 of the base 302 of the chimney 300.

Figure 9:
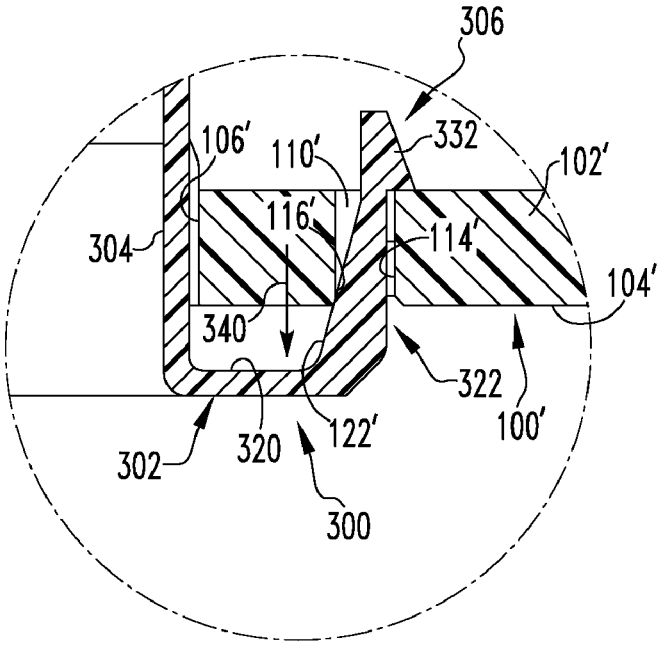
FIG. 9 is a close-up sectional view of a portion of the chimney of FIG. 8, also showing a portion of the arc hood assembly.

As shown in FIG. 9, the chimney 300 cooperates with the arc hood assembly 100' and, in particular, aperture 106' and slot 110' on the first side 104' of the body 102' of the arc hood assembly 100', in much the same manner as the tabs 206,208 of chimney 200, previously discussed. However, rather than having a taper disposed on the external side of the tab (see, for example, taper 122 on the external side of the first tab 206 of FIG. 7), tab 306 of chimney 300 includes a taper 122' extending from at or about the planar portion 320 of the base 302 toward the barb 332, on the interior side of the tab 306. Accordingly, rather than engaging the first edge 114 of the first slot 110, as shown in FIG. 7, taper 122' of the first tab 306 of chimney 300 engages the second edge 116' of the first slot 100', as shown in FIG. 9, in order to bias the chimney 300 toward the circuit breaker housing 4 (not shown in FIG. 9; see housing 4 shown in simplified form in phantom line drawing in FIG. 7) in the direction generally indicated by arrow 340.

Figure 10:
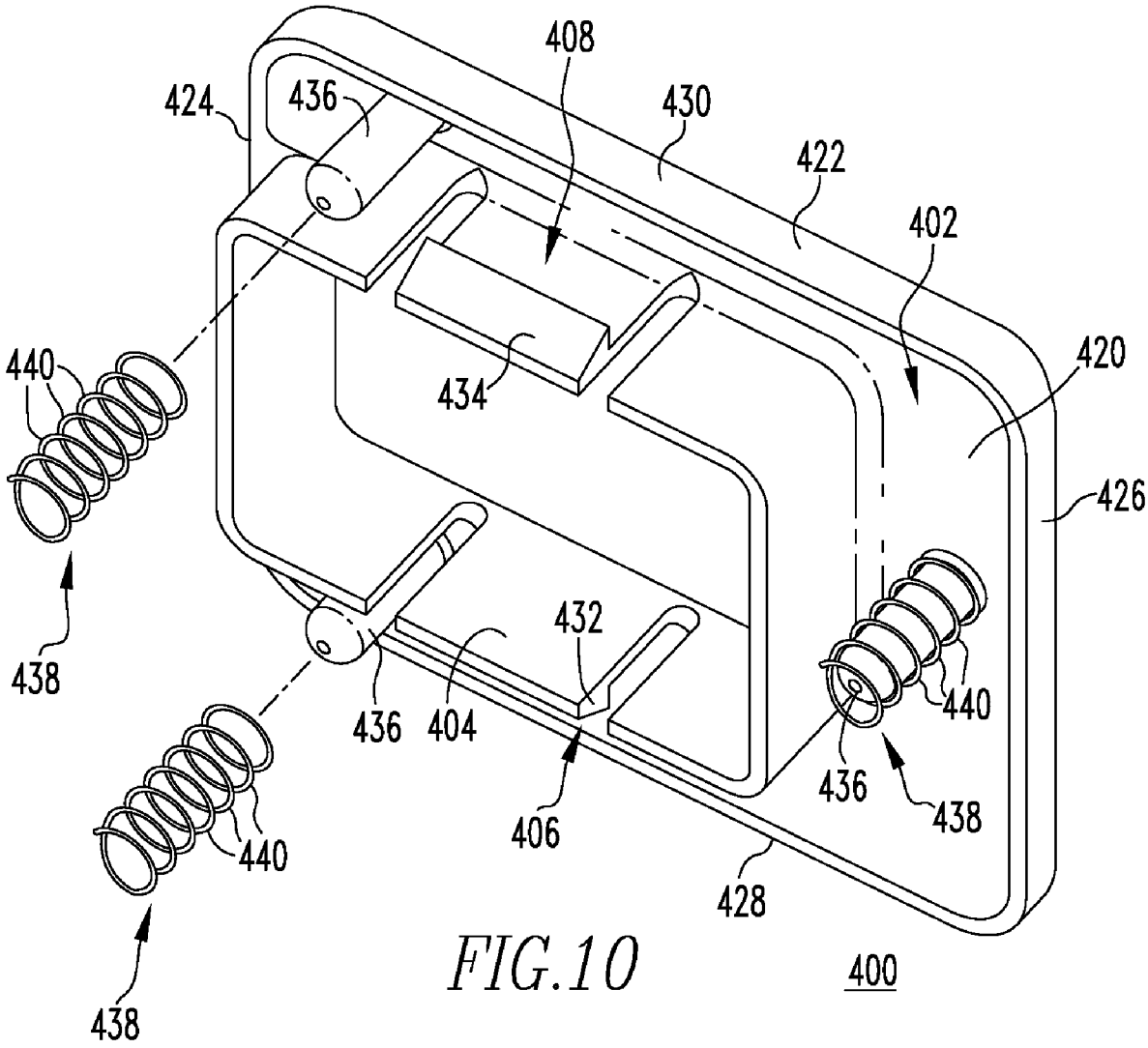
FIG. 10 is an isometric, partially exploded view of a chimney in accordance with another embodiment of the invention.

FIG. 10 shows a chimney 400 in accordance with another embodiment of the invention. The chimney 400 includes a base 402 with a planar portion 420, which is generally rectangular in shape and includes first and second opposing sides 424,426 and first and second opposing edges 428,430, and a duct 404, first and second tabs 406,408 and an upturned collar 422 all of which extend generally perpendicularly outwardly from the planar portion 420, as shown. Each of the first and second tabs 406,408 comprises a portion of the duct 404, and includes a corresponding barb 432,434. In the example of FIG. 10, the chimney 400 also includes three posts 436, which extend perpendicularly outwardly from the planar portion 420 of the base 402, and receive resilient elements such as, for example and without limitation, the springs 438, which are shown. More specifically, each spring 438 includes a plurality of coils 440, and each post 436 is disposed through the coils 440 of a corresponding one of the springs 438. Unlike chimneys 200 and 300 discussed hereinabove, it is the springs 438, or other suitable resilient element (not shown), rather than the first and second tabs 406,408, that function to bias the chimney 400 toward the circuit breaker housing 4 (not shown in FIG. 10). Accordingly, chimney 400 provides an alternative mechanism to the aforementioned tapers 122,124 (FIGS. 5 and 6), 122',124' (FIG. 8), to bias the chimney 400 and to maintain a seal between the chimney 400 and housing 4 (not shown in FIG. 10), thereby resisting undesired escaping of arc gasses 14 (FIGS. 2 and 5) therebetween.

The arc hood assembly 100 will now be discussed in greater detail with reference to FIGS. 3-5. Specifically, the example arc hood assembly 100 includes a top 130, a bottom 132, a fastening mechanism 136, which in the example shown and described herein is a plurality of screws 136 (four are shown) securing the top 130 and bottom 132, first and second opposing edges 138,140, and first and second ends 142,144. It will, however, be appreciated that any known or suitable alternative fastener (not shown), as defined herein, or fastening mechanism (not shown), could be employed in any known or suitable alternative number and/or configuration (not shown) without departing from the scope of the invention.

The example arc hood assembly 100 further includes a terminal mount 150 coupled to the first end 142 of the body 102. The terminal mount 150 includes at least one protrusion 152,154 (two are shown), as shown in FIGS. 3 and 4. The protrusions 152,154 are structured to be coupled to the first end 22 of the circuit breaker housing 4 (see, for example, protrusion 152 partially shown engaging the first end 22 of circuit breaker housing 4 in FIG. 1). Accordingly, when the arc hood assembly 100 is coupled to the circuit breaker 2, as shown in FIG. 1, the first end 142 of the body 102 of the arc hood assembly 100 faces the front 30 of the circuit breaker housing 4, and the second end 144 of the body 102 faces the back 32 of the circuit breaker housing 4. The first edge 138 of the body 102 of the arc hood assembly 100 is generally aligned with the first side 32 of the circuit breaker housing 4, and the second edge 140 is generally aligned with the second side 28 of the circuit breaker housing 4. Also, when the first edge 138 of the body 102 of the arc hood assembly 100 is coupled to the end 178 of the first side 174 of the aforementioned circuit breaker cassette 170, and the second edge 140 of the body 102 of the arc hood assembly 100 is coupled to the end 180 of the second side 176 of the cassette 170, the first and second recesses 186 and 188, are accessible through the aforementioned first and second recesses 182 and 184, respectively, of the first and second cassette sides 174,176 (see, for example, recess 186 of arc hood assembly 100 accessible through access hole 182 of the cassette 170 in the example of FIG. 1). In this manner, the recesses 186,188 may, for example, serve as handles for facilitating the manipulation (e.g., without limitation, transporting; lifting; inserting; withdrawing) of the circuit breaker 2.

As shown in FIG. 3, the terminal mount 150 of the example arc hood assembly 100 further includes a DIN rail 156, and a comb 158 that extends outwardly from the DIN rail 156 on the first end 142 of the body 102 of the arc hood assembly 100. The comb 158 is structured to receive and secure a plurality of terminals such as, for example and without limitation, the user terminals 160 shown in the example of FIGS. 1 and 2. The DIN rail 156, which is also partially shown in FIGS. 1 and 2, is preferably made of an electrically conductive material (e.g., without limitation, a suitable conductive metal) and, therefore, is structured to electrically connect such terminals 160 (FIGS. 1 and 2) to the circuit breaker 2. It will, however, be appreciate that the primary function of the disclosed arc hood assembly 100 (see also arc hood assembly 100' partially shown in FIG. 9) is to receive and dissipate arc gasses 14 (FIGS. 1, 2 and 5) through the disclosed chimneys 200 (FIGS. 3-7), 300 (FIGS. 8 and 9), 400 (FIG. 10), which are structured to resist the undesired escape of gasses between the arc hood assembly 100 (FIGS. 1-5 and 7), 100' (FIG. 9) and circuit breaker housing 4 (FIGS. 1 and 2; see also circuit breaker housing 4 partially shown in simplified form in phantom line drawing in FIGS. 5 and 7). It will, therefore, be appreciated that any known or suitable alternative configuration of arc hood assembly (not shown) which employs such chimneys (e.g., without limitation, 200,300,400) in any known or suitable number and configuration, could be employed, without departing from the scope of the invention. It will, therefore, also be appreciated that certain components of the arc hood assembly 100 such as, for example and without limitation, the aforementioned terminal mount 150 and/or the protrusions 152,154, the DIN rail 156, the comb 158, and the terminals 160 thereof, are not meant to be limiting aspects of the disclosed invention and, therefore, are not required.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A chimney for an arc hood assembly of an electrical switching apparatus including a housing and a number of arc chute vents structured to exhaust arc gases from said housing, said arc hood assembly including a body having a first side facing said housing, and a second side disposed opposite the first side, the first side including a number of apertures, said chimney comprising:

a base structured to be disposed at or about a corresponding one of said number of arc chute vents;

a duct structured to extend outwardly from said base and through a corresponding one of said number of apertures; and a plurality of resilient protrusions structured to movably couple said chimney to the first side of said body at or about said corresponding one of said number of apertures, wherein, when said arc gases are exhausted from said corresponding one of said number of arc chute vents, said duct is structured to receive said arc gases and direct them into said body of said arc hood assembly, and wherein said resilient protrusions are structured to bias said base toward engagement with said housing at or about said corresponding one of said number of arc chute vents, in order to resist said arc gases being undesirably discharged between said base and said housing.

2. The chimney of claim 1 wherein said base comprises a planar portion and an upturned collar extending outwardly from said planar portion; wherein said upturned collar is structured to extend toward the first side of said body of said arc hood assembly; wherein said duct extends outwardly from said planar portion; and wherein said resilient protrusions extend outwardly from said planar portion at or about said upturned collar and generally parallel with respect to said duct.

3. The chimney of claim 2 wherein said base has a first end, a second end disposed opposite and distal from the first end, a first edge, and a second edge disposed opposite and distal from the first edge; and wherein said resilient protrusions are a first tab disposed at or about the first edge of said base, and a second tab disposed at or about the second edge of said base opposite said first tab.

4. The chimney of claim 3 wherein the first side of said body of said arc hood assembly further includes a first slot disposed proximate said corresponding one of said number of apertures, and a second slot disposed proximate said corresponding one of said number of apertures opposite said first slot; wherein each of said first tab and said second tab extends outwardly from said planar portion of said base and through a corresponding one of said first slot and said second slot; and wherein each of said first tab and said second tab includes a barb structured to secure said chimney to the first side of said body of said arc hood assembly, without a number of separate fasteners.

5. The chimney of claim 4 wherein each of said first slot and said second slot has an edge; wherein each of said first tab and said second tab further includes a taper extending from at or about said planar portion of said base toward said barb; wherein said taper is structured to engage said corresponding one of said edge of said first slot and said edge of said second slot; and wherein, when said base engages said housing and said taper engages said corresponding one of said edge of said first slot and said edge of said second slot, said taper is structured to bias said base toward said housing in order to resist said base becoming disengaged from said housing.

6. The chimney of claim 2 wherein said base further comprises a plurality of posts and a plurality of resilient elements; wherein said posts are structured to extend outwardly from said planar portion and toward the first side of said body of said arc hood assembly; wherein each of said resilient elements is structured to be disposed on a corresponding one of said posts between said planar portion of said base and the first side of said body of said arc hood assembly; and wherein said bias elements are structured to bias said chimney toward said housing.

7. The chimney of claim 6 wherein said plurality of posts is three posts; wherein said plurality of resilient elements is three springs; wherein each of said springs has coils; and wherein each of said posts is disposed within said coils of a corresponding one of said springs.

8. The chimney of claim 1 wherein said chimney is a single-piece molded member; and wherein said base, said duct, and said resilient protrusions comprise different segments of said single-piece molded member.

9. An arc hood assembly for an electrical switching apparatus including a housing and a number of arc chute vents structured to exhaust arc gases from said housing, said arc hood assembly comprising:

a body including a first side structured to face said housing, and a second side disposed opposite the first side, the first side including a number of apertures; and a number of chimneys, each of said chimneys comprising:

a base structured to be disposed at or about a corresponding one of said number of arc chute vents, a duct extending outwardly from said base and through a corresponding one of said number of apertures, and a plurality of resilient protrusions movably coupling said each of said chimneys to the first side of said body at or about said corresponding one of said number of apertures, wherein, when said arc gases are exhausted from said corresponding one of said number of arc chute vents, said duct is structured to receive said arc gases and direct them into said body of said arc hood assembly, and wherein said resilient protrusions are structured to bias said base toward engagement with said housing at or about said corresponding one of said number of arc chute vents, in order to resist said arc gases being undesirably discharged between said base and said housing.

10. The arc hood assembly of claim 9 wherein said base comprises a planar portion and an upturned collar extending outwardly from said planar portion; wherein said upturned collar extends toward the first side of said body of said arc hood assembly; wherein said duct extends outwardly from said planar portion; and wherein said resilient protrusions extend outwardly from said planar portion at or about said upturned collar and generally parallel with respect to said duct.

11. The arc hood assembly of claim 10 wherein said base has a first end, a second end disposed opposite and distal from the first end, a first edge, and a second edge disposed opposite and distal from the first edge; wherein said resilient protrusions are a first tab disposed at or about the first edge of said base, and a second tab disposed at or about the second edge of said base opposite said first tab; wherein the first side of said body of said arc hood assembly further includes a first slot disposed proximate said corresponding one of said number of apertures, and a second slot disposed proximate said corresponding one of said number of apertures opposite said first slot; wherein each of said first tab and said second tab extends outwardly from said planar portion of said base and through a corresponding one of said first slot and said second slot; and wherein each of said first tab and said second tab includes a barb securing said chimney to the first side of said body of said arc hood assembly, without a number of separate fasteners.

12. The arc hood assembly of claim 11 wherein each of said first slot and said second slot has an edge; wherein each of said first tab and said second tab further includes a taper extending from at or about said planar portion of said base toward said barb; wherein said taper is engageable with said corresponding one of said edge of said first slot and said edge of said second slot; and wherein, when said base engages said housing and said taper engages said corresponding one of said edge of said first slot and said edge of said second slot, said taper is structured to bias said base toward said housing in order to resist said base becoming disengaged from said housing.

13. The arc hood assembly of claim 10 wherein said base further comprises a plurality of posts and a plurality of resilient elements; wherein said posts extend outwardly from said planar portion and toward the first side of said body of said arc hood assembly; wherein each of said resilient elements is disposed on a corresponding one of said posts between said planar portion of said base and the first side of said body of said arc hood assembly; and wherein said bias elements bias said chimney toward said housing.

14. An electrical switching apparatus comprising:

a housing;

separable contacts enclosed by said housing;

an operating mechanism structured to open and close said separable contacts, which are structured to create an arc that generates arc gases when said separable contacts open;

a number of arc chute vents disposed on said housing and being structured to exhaust said arc gases from said housing; and an arc hood assembly comprising:

a body including a first side facing said housing, and a second side disposed opposite the first side, the first side including a number of apertures, and a number of chimneys, each of said chimneys comprising:

a base structured to be disposed at or about a corresponding one of said number of arc chute vents, a duct extending outwardly from said base and through a corresponding one of said number of apertures, and a plurality of resilient protrusions movably coupling said each of said chimneys to the first side of said body at or about said corresponding one of said number of apertures, wherein said arc gases are exhausted from said corresponding one of said arc chute vents, through said duct, and into said body of said arc hood assembly, and wherein said resilient protrusions bias said base toward engagement with said housing at or about said corresponding one of said number of arc chute vents, in order to resist said arc gases being undesirably discharged between said base and said housing.

15. The electrical switching apparatus of claim 14 wherein said base comprises a planar portion and an upturned collar extending outwardly from said planar portion; wherein said upturned collar extends toward the first side of said body of said arc hood assembly; wherein said duct extends outwardly from said planar portion; and wherein said resilient protrusions extend outwardly from said planar portion at or about said upturned collar and generally parallel with respect to said duct.

16. The electrical switching apparatus of claim 15 wherein said base has a first end, a second end disposed opposite and distal from the first end, a first edge, and a second edge disposed opposite and distal from the first edge; wherein said resilient protrusions are a first tab disposed at or about the first edge of said base, and a second tab disposed at or about the second edge of said base opposite said first tab; wherein the first side of said body of said arc hood assembly further includes a first slot disposed proximate said corresponding one of said number of apertures, and a second slot disposed proximate said corresponding one of said number of apertures opposite said first slot; wherein each of said first tab and said second tab extends outwardly from said planar portion of said base and through a corresponding one of said first slot and said second slot; and wherein each of said first tab and said second tab includes a barb securing said chimney to the first side of said body of said arc hood assembly, without a number of separate fasteners.

17. The electrical switching apparatus of claim 16 wherein each of said first slot and said second slot has an edge; wherein each of said first tab and said second tab further includes a taper extending from at or about said planar portion of said base toward said barb; wherein said taper is structured to engage said corresponding one of said edge of said first slot and said edge of said second slot; and wherein, when said base engages said housing and said taper engages said corresponding one of said edge of said first slot and said edge of said second slot, said taper biases said base toward said housing in order to resist said base becoming disengaged from said housing.

18. The electrical switching apparatus of claim 15 wherein said base further comprises a plurality of posts and a plurality of resilient elements; wherein said posts extend outwardly from said planar portion and toward the first side of said body of said arc hood assembly; wherein each of said resilient elements is disposed on a corresponding one of said posts between said planar portion of said base and the first side of said body of said arc hood assembly; and wherein said bias elements bias said chimney toward said housing.

19. The electrical switching apparatus of claim 14 wherein said housing of said electrical switching apparatus includes a first end having three arc chute vents, and a second end; wherein said number of apertures of said body is three apertures; wherein said number of chimneys is three chimneys, each being disposed in a corresponding one of said apertures; and wherein each of said three chimneys is aligned with a corresponding one of said arc chute vents.

20. The electrical switching apparatus of claim 14 wherein said housing of said electrical switching apparatus includes a first end, a second end, a first side, a second side, a front and a back; wherein said body of said arc hood assembly comprises a top, a bottom, a fastening mechanism securing said top to said bottom, a first edge, a second edge disposed opposite the first edge, a first end, a second end disposed opposite the first end of said body, and a terminal mount coupled to the first end of said body and including at least one protrusion; wherein said at least one protrusion of said terminal mount is coupled to the first end of said housing of said electrical switching apparatus; wherein the first end of said body of said arc hood assembly faces the front of said housing of said electrical switching apparatus and the second end of said body faces the back of said housing; and wherein the first edge of said body of said arc hood assembly is generally aligned with the first side of said housing of said electrical switching apparatus and the second edge of said body is generally aligned with the second side of said housing.

21. The electrical switching apparatus of claim 20 wherein said fastening mechanism is a plurality of fasteners securing the top of said body of said arc hood assembly to the bottom of said body; wherein said terminal mount comprises a DIN rail and a comb extending outwardly from said DIN rail; wherein said comb is structured to receive and secure a plurality of terminals; and wherein said DIN rail is structured to electrically connect said terminals to said electrical switching apparatus.

22. The electrical switching apparatus of claim 21 wherein said electrical switching apparatus is a circuit breaker; wherein said housing of said circuit breaker further includes a cassette having a bottom, and first and second sides extending perpendicularly outwardly from said bottom; wherein each of the first and second sides of said cassette includes an end; wherein said circuit breaker is disposed between the first and second sides of said cassette; wherein each of the first edge of said body of said arc hood assembly and the second edge of said body of said arc hood assembly is coupled to a corresponding one of said first and second sides of said cassette at or about the end thereof.

23. The electrical switching apparatus of claim 22 wherein the end of said each of the first and second sides of said cassette has an access hole; wherein said each of the first edge of said body of said arc hood assembly and the second edge of said body of said arc hood assembly comprises a recess; and wherein said recess is accessible through said access hole.

* * * * *